US010125562B2

(12) United States Patent
Maher

(10) Patent No.: US 10,125,562 B2
(45) Date of Patent: Nov. 13, 2018

(54) EARLY PRODUCTION SYSTEM FOR DEEP WATER APPLICATION

(71) Applicant: Trendsetter Vulcan Offshore, Inc., Houston, TX (US)

(72) Inventor: James V. Maher, Houston, TX (US)

(73) Assignee: Trendsetter Vulcan Offshore, Inc., Houston, TX (US)

( * ) Notice: Subject to any disclaimer, the term of this patent is extended or adjusted under 35 U.S.C. 154(b) by 0 days.

(21) Appl. No.: 15/565,100

(22) PCT Filed: Jun. 13, 2017

(86) PCT No.: PCT/US2017/037339
§ 371 (c)(1),
(2) Date: Oct. 6, 2017

(87) PCT Pub. No.: WO2017/218596
PCT Pub. Date: Dec. 21, 2017

(65) Prior Publication Data

US 2018/0058166 A1 Mar. 1, 2018

Related U.S. Application Data

(60) Provisional application No. 62/349,413, filed on Jun. 13, 2016.

(51) Int. Cl.

| | |
|---|---|
| ***E21B 33/035*** | (2006.01) |
| ***E21B 34/04*** | (2006.01) |
| ***E21B 43/36*** | (2006.01) |
| ***E21B 47/06*** | (2012.01) |
| *E21B 33/064* | (2006.01) |
| *E21B 43/013* | (2006.01) |

(52) U.S. Cl.
CPC ..... *E21B 33/0355* (2013.01); *E21B 34/04* (2013.01); *E21B 43/36* (2013.01); *E21B 47/06* (2013.01); *E21B 33/064* (2013.01); *E21B 43/013* (2013.01)

(58) Field of Classification Search
CPC .... E21B 33/0355; E21B 34/04; E21B 43/013; E21B 43/36; E21B 47/06
See application file for complete search history.

(56) References Cited

U.S. PATENT DOCUMENTS

| | | | | |
|---|---|---|---|---|
| 6,102,124 | A * | 8/2000 | Skeels | E21B 33/0355 166/347 |
| 9,038,728 | B1 * | 5/2015 | Lugo | E21B 33/064 166/338 |
| 9,273,536 | B2 * | 3/2016 | Brock | E21B 41/0007 |
| 2005/0061515 | A1 | 3/2005 | Hopper | |
| 2010/0025044 | A1 * | 2/2010 | McKay | E21B 33/035 166/359 |

(Continued)

*Primary Examiner* — Matthew R Buck
(74) *Attorney, Agent, or Firm* — Jonathan M. Pierce; Porter Hedges LLP

(57) ABSTRACT

An early production system includes an Emergency Disconnect Package ("EDP"), a production riser coupled between the EDP and a sea surface processing facility, a gas export tubing coupled between the EDP and the sea surface processing facility, and a flow base. The flow base is detachably connectable to the EDP. The flow base also includes an Independent Production Control System ("IPCS") for controlling at least one production valve.

36 Claims, 13 Drawing Sheets

(56) References Cited

U.S. PATENT DOCUMENTS

| | | | | |
|---|---|---|---|---|
| 2012/0067589 | A1* | 3/2012 | Fenton | E21B 17/06 166/340 |
| 2014/0231090 | A1 | 8/2014 | Sundararajan et al. | |
| 2014/0262306 | A1* | 9/2014 | Hosie | E21B 33/038 166/336 |
| 2016/0090810 | A1* | 3/2016 | Holmes | E21B 34/16 166/363 |
| 2017/0247986 | A1* | 8/2017 | Bussell | E21B 41/0092 |

* cited by examiner

EARLY PRODUCTION SYSTEM FOR DEEP WATER APPLICATION

BACKGROUND

This disclosure relates generally to systems suitable for early production in deep water applications. In some examples, this disclosure relates to systems suitable for early production in high pressure and/or high temperature environments. In some examples, this disclosure relates to systems suitable for early production that permit handling production of gas.

Early production systems may be needed to evaluate a hydrocarbon reservoir accessed by a wellbore recently drilled to the reservoir. To evaluate the reservoir, the reservoir is often produced for a short period of time (e.g., to perform a draw down and shut-off test or other well tests). Because reservoir evaluation is short (compared to the period of production of the reservoir), a dynamic positioning ("DP") system, rather than a full mooring system, is often used to maintain a hydrocarbon processing facility on the sea surface above a wellhead terminating the wellbore at the sea bed. For example, a Mobile Offshore Drilling Unit ("MODU") or a drill ship connect to the wellhead may be used process the hydrocarbon fluid produced by the reservoir. A tanker vessel can in turn be connected to the MODU and can move relative to the MODU. The tanker vessel stores the hydrocarbon produced. When using a DP system, it is required to be able to disconnect from the wellhead on very short notice (emergency disconnect). It is also advantageous to have a single point of connection.

The MODU may be connected to the wellhead via a vertical tree and a riser. This technology has been used in a number of prior applications, such as completion and workovers. For early production however, more than a single seafloor connection may be required. Also, advanced functionality—such as a High-Integrity Pressure Protection System ("HIPPS") or other additional safety systems, may often be needed. Thus, there is a continuing need in the art for methods and apparatus for providing early production systems that may be used in high pressure and/or high temperature environments ("HPHT environments"). The early production systems may optionally permit handling production of gas dissolved in the reservoir hydrocarbon.

BRIEF SUMMARY OF THE DISCLOSURE

The disclosure describes an early production system. The early production system comprises an Emergency Disconnect Package ("EDP") including a first conduit having a fail-safe close production valve, and an EDP connector having a first port fluidly coupled to the first conduit. The early production system also comprises a production riser coupled between the first conduit of the EDP and a Dynamically Positioned Vessel. The early production system also comprises a flow base. The flow base includes a second conduit, an Independent Production Control System ("IPCS") having production shut-down valves, a first sensor of wellbore pressure or temperature, and a flow base connector having a second port fluidly coupled to the second conduit. The flow base connector is detachably connectable to the EDP connector. The first port and the second port are in fluid communication upon connection of the flow base connector with the EDP connector. The early production system also comprises a jumper coupled between the second conduit and a wellhead tree capping a wellbore. The early production system also comprises a control pod having pre-charged accumulators and logic electronics that is communicatively coupled to the first sensor and to the IPCS, wherein the control pod is configured to operate the production shut-down valves even after disconnection of the EDP from the flow base, and wherein the logic electronics are programmed to shut down flow between the flow base and the EDP based on a signal generated by the first sensor. The logic electronics may further be programmed to control pressure surges in the production riser. The early production system may further comprise a second sensor of positioning of the Dynamically Positioned Vessel over the wellbore. The second sensor may be an inclinometer positioned in the flow base. The control pod may be coupled to valves located in the wellhead tree via flying leads. The logic electronics may be programmed to control the valves even after disconnection of the EDP from the flow base. The early production system may further comprise an umbilical running along the production riser. The umbilical may comprise flying leads connected to the valves located in the wellhead tree to control the valves before disconnection of the EDP from the flow base. The flow base may be mounted to a structural foundation. The flow base may be mounted to the wellhead tree. The Dynamically Positioned Vessel may be a Mobile Offshore Drilling Unit ("MODU"), a drill ship, a Production Vessel, or an Intervention Vessel.

The disclosure describes another early production system. The early production system comprises an Emergency Disconnect Package ("EDP") including a first conduit having a fail-safe close production valve, and an EDP connector having a first port fluidly coupled to the first conduit. The early production system comprises a production riser coupled between the first conduit of the EDP and a Dynamically Positioned Vessel. The early production system comprises a flow base including a second conduit, an Independent Production Control System ("IPCS") having production shut-down valves, a first sensor of wellbore pressure or temperature, and a flow base connector having a second port fluidly coupled to the second conduit, wherein the flow base connector is detachably connectable to the EDP connector, and wherein the first port and the second port are in fluid communication upon connection of the flow base connector with the EDP connector. The early production system comprises a jumper coupled between the second conduit and a wellhead tree capping a wellbore. The early production system comprises a control pod having battery packs, a pumping system, and logic electronics that is communicatively coupled to the first sensor and to the IPCS, wherein the control pod is configured to operate the production shut-down valves even after disconnection of the EDP from the flow base, and wherein the logic electronics are programmed to shut down flow between the flow base and the EDP based on a signal generated by the first sensor. The logic electronics may further be programmed to control pressure surges in the production riser. The early production system may further comprise a second sensor of positioning of the Dynamically Positioned Vessel over the wellbore. The second sensor may be an inclinometer positioned in the flow base. The control pod may be coupled to valves located in the wellhead tree via flying leads. The logic electronics may be programmed to control the valves even after disconnection of the EDP from the flow base. The early production system may further comprise an umbilical running along the production riser. The umbilical may comprise flying leads connected to the valves located in the wellhead tree to control the valves before disconnection of the EDP from the flow base. The flow base may be mounted to a structural foundation. The flow base may be mounted to the wellhead tree. The Dynamically Positioned Vessel may be a Mobile Offshore Drilling Unit ("MODU"), a drill ship, a Production Vessel, or an Intervention Vessel.

The disclosure also describes a method of operating an early production system. The method comprises providing an Emergency Disconnect Package ("EDP") including a first conduit having a fail-safe close production valve, and an EDP connector having a first port fluidly coupled to the first conduit. The method also comprises coupling a production riser between the first conduit of the EDP and a Dynamically Positioned Vessel. The method also comprises providing a flow base including a second conduit having, an Independent Production Control System ("IPCS") having production shut-down valves, a first sensor of wellbore pressure or temperature, and a flow base connector having a second port fluidly coupled to the second conduit. The method also comprises connecting the flow base connector to the EDP connector, wherein the first port and the second port are in fluid communication upon connection of the flow base connector with the EDP connector. The method comprises coupling a jumper between the second conduit and a wellhead tree capping a wellbore. The method also comprises providing a control pod having pre-charged accumulators and logic electronics that is communicatively coupled to the first sensor and to the IPCS. The method also comprises causing the production shut-down valves to limit pressure surges in the production riser. The method also comprises causing the production shut-down valves to shut down a flow between the flow base and the EDP based on a signal generated by the first sensor. The method may further comprise providing a second sensor of a dynamic positioning that generates a signal indicative of a positioning of the Dynamically Positioned Vessel over the wellbore. The method may further comprise causing the production shut-down valves to shut down a flow between the flow base and the EDP in response to the signal of the second sensor exceeding a critical value. The method may further comprise causing the EDP to disconnect from the flow base in response to the signal of the second sensor exceeding the critical value. The method may further comprise disconnecting the flow base connector from the EDP connector. The method may further comprise causing the production shut-down valves to maintain the flow between the flow base and the EDP shut down after disconnection of the EDP from the flow base. The method may further comprise providing valves in the wellhead tree. The method may further comprise coupling the control pod to the valves via flying leads. The method may further comprise causing the IPCS to close the valves after disconnection of the EDP from the flow base. The method may further comprise providing an umbilical running along the production riser, the umbilical comprising flying leads connected to the valves located in the wellhead tree. The method may further comprise using the umbilical to control the valves before disconnection of the EDP from the flow base. The method may further comprise flushing at least a portion of the first conduit or the second conduit prior to disconnecting the flow base connector from the EDP connector. The method may further comprise causing the IPCS to shut down flow between the flow base and the EDP after detection of a pressure drop. The method may further comprise initiating disconnection of the EDP from the flow base after causing the production shut-down valves to shut down a flow between the flow base and the EDP based on a signal generated by the first sensor. Initiating disconnection of the EDP from the flow base may comprise releasing a lock between the flow base connector and the EDP connector.

The disclosure also describes a method of operating an early production system. The method comprises providing an Emergency Disconnect Package ("EDP") including a first conduit having a fail-safe close production valve, and an EDP connector having a first port fluidly coupled to the first conduit. The method also comprises coupling a production riser between the first conduit of the EDP and a Dynamically Positioned Vessel. The method also comprises providing a flow base including a second conduit having, an Independent Production Control System ("IPCS") having production shut-down valves, a first sensor of wellbore pressure or temperature, and a flow base connector having a second port fluidly coupled to the second conduit. The method also comprises connecting the flow base connector to the EDP connector, wherein the first port and the second port are in fluid communication upon connection of the flow base connector with the EDP connector. The method also comprises coupling a jumper between the second conduit and a wellhead tree capping a wellbore. The method also comprises providing a control pod having battery packs, a pumping system, and logic electronics that is communicatively coupled to the first sensor and to the IPCS. The method also comprises causing the production shut-down valves to limit pressure surges in the production riser. The method also comprises causing the production shut-down valves to shut down a flow between the flow base and the EDP based on a signal generated by the first sensor. The method may further comprise providing a second sensor of a dynamic positioning that generates a signal indicative of a positioning of the Dynamically Positioned Vessel over the wellbore. The method may further comprise causing the production shut-down valves to shut down a flow between the flow base and the EDP in response to the signal of the second sensor exceeding a critical value. The method may further comprise causing the EDP to disconnect from the flow base in response to the signal of the second sensor exceeding the critical value. The method may further comprise disconnecting the flow base connector from the EDP connector. The method may further comprise causing the production shut-down valves to maintain the flow between the flow base and the EDP shut down after disconnection of the EDP from the flow base. The method may further comprise providing valves in the wellhead tree. The method may further comprise coupling the control pod to the valves via flying leads. The method may further comprise causing the IPCS to close the valves after disconnection of the EDP from the flow base. The method may further comprise providing an umbilical running along the production riser, the umbilical comprising flying leads connected to the valves located in the wellhead tree. The method may further comprise using the umbilical to control the valves before disconnection of the EDP from the flow base. The method may further comprise flushing at least a portion of the first conduit or the second conduit prior to disconnecting the flow base connector from the EDP connector. The method may further comprise causing the IPCS to shut down flow between the flow base and the EDP after detection of a pressure drop. The method may further comprise initiating disconnection of the EDP from the flow base after causing the production shut-down valves to shut down a flow between the flow base and the EDP based on a signal generated by the first sensor. Initiating disconnection of the EDP from the flow base may comprise releasing a lock between the flow base connector and the EDP connector.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
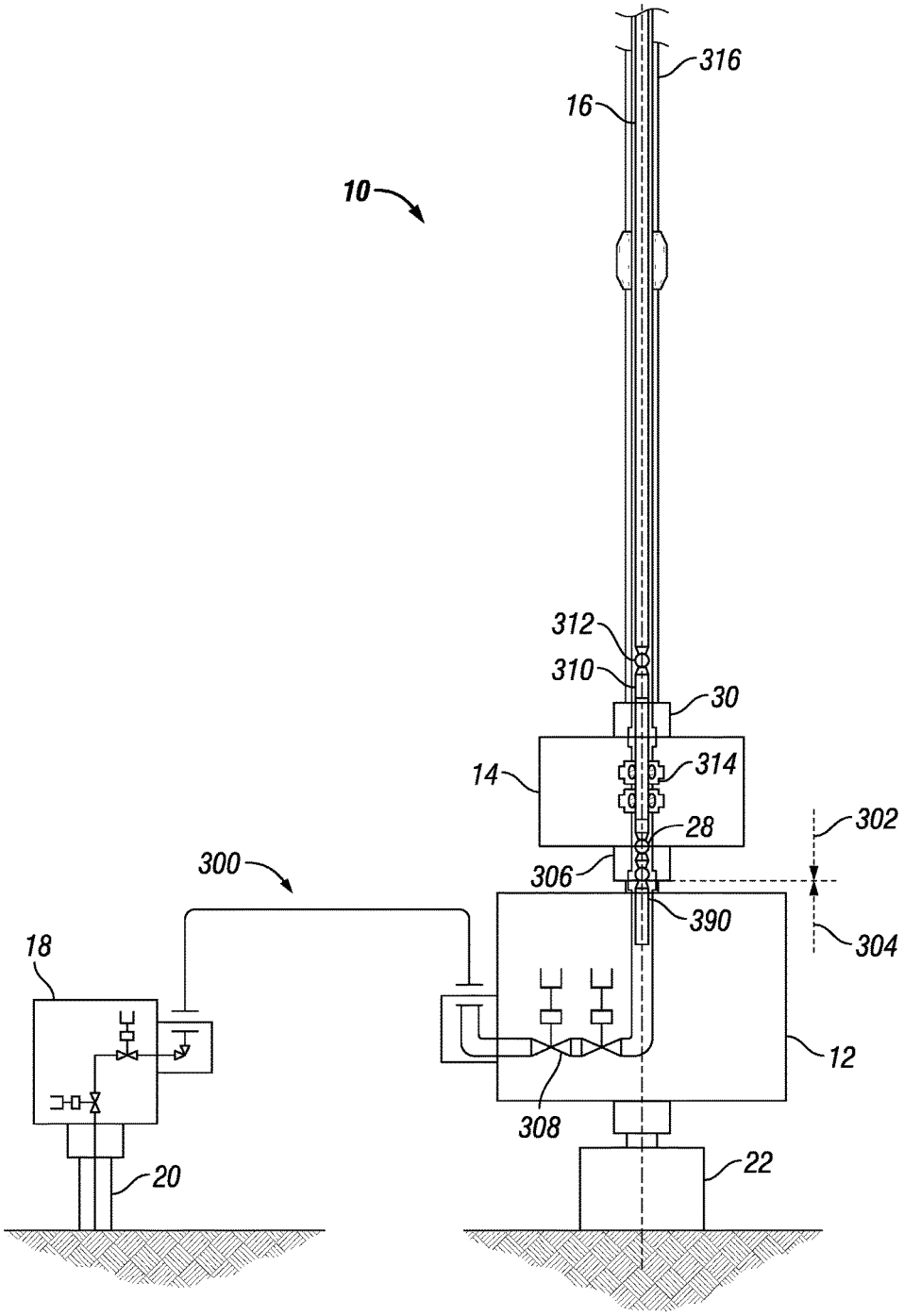
FIG. 1 is schematic view of an early production system in accordance with an embodiment of the disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Methods and systems for early production are disclosed that may alleviate the impact of disconnection of the wellhead from a dynamically positioned vessel, provide capabilities to connect to gas export facilities, as well as provide additional safety systems advantageous when producing in HPHT environments.

In one or more aspects, an early production system comprises a jumper to connect to a wellhead tree capping a wellbore, a flow base connected to the jumper and including a HIPPS, a Lower Marine Riser Package ("LMRP") connected to the flow base, a production riser, an outer riser and a production riser. The production riser is to connect the LMRP to a sea surface processing facility. The surface processing facility may be located on a MODU or a drill ship positioned dynamically.

In one or more aspects, an early production system comprises a jumper to connect to a wellhead tree capping a wellbore, a flow base connected to the jumper and including a HIPPS, a Lower Riser Package ("LRP"), a production riser, and an outer riser. The production riser is to connect the LRP to a surface processing facility. An EDP permits disconnection of both the outer riser and the production riser from the LRP.

In one or more aspects, the early production system may further comprise a gas export tubing. The gas export tubing may be provided in an annulus between the production riser and the outer riser. The gas export tubing may be provided with flushing mechanism for commissioning, with means for hydrate prevention (e.g., heating) and temporary pigging. The gas export tubing is to connect to a PLET and to flow gas escaping from the hydrocarbon produced by the wellbore. The gas escaping separators provided with the sea surface processing facility may be compressed and injected into the gas export tubing.

In one or more aspects, the early production system may add levels of safety and reliability in the production equipment, rather than in the dynamic positioning system. The early production system may have the capability that are currently used in surge protection such as a HIPPS. The early production system may be used in combination with the Dynamic Positioning ("DP") system to mitigate the consequences of a positioning failure.

In some embodiments, pre-charged accumulators can be used for providing a pressure source for the HIPPS valves. Thus the control system, by using shutdown logic built in the flow base, may be totally independent. The same accumulators may also be used to control the production tree, providing several levels of redundant control. Alternatively, the flow base may rely on an all-electronic actuation system. In this case, battery packs and associated pumping systems may replace the pre-charged accumulators.

Thus, the HIPPS functionality may be enhanced to provide an IPCS. As used herein, a HIPPS utilizes specific pressure measurement along the production tubing and a specific logic electronics to operate at least one shut down valve on the production tubing in response to the detection of a pressure surge above the pressure rating of the production riser. As used herein, an IPCS more generally comprise a dedicated power source (pre-charged accumulators, battery packs and associated pumping systems) and a versatile logic electronics to actuate at least one shut down valve on the production tubing. However, the versatile logic electronics also operate the at least one shut down valve on the production tubing, but it is not limited to responding to the detection of a pressure surge above the pressure rating of the production riser as are the specific logic electronics of the HIPPS. For example, the versatile logic electronics may implement, on the seabed, the pressure safety functionally of a Safety Systems for Offshore Production Facilities qualified under the American Petroleum Institute ("API") standard RP 14C, in supplement of the functionality of safety systems such as a HIPPS. Such pressure safety functionality may typically include Pressure Safety High Low ("PSHL") and Pressure Safety High High ("PSHH") type alarms. Thus, an IPCS includes shutdown logic built in the logic electronics that can also mitigate or prevent rapid discharge if a drive-off event has occurred. As mentioned before, the IPCS, by acting as a HIPPS, also allows a reduction of the pressure specification, typically from 20,000 psi in the wellhead to 15,000 psi in the production riser.

In some embodiments, the early production system may reduce the risk and/or amount of any discharge of hydrocarbon into the environment by introducing back-fill flushing device, which may include a cavity (for example at atmospheric pressure) in the flow base. The cavity may be used to capture fluids during shutdown sequence. The cavity may be coupled to a valve and may be upstream any flow path for the flow base. The cavity may alternatively be pressurized to displace fluids, for example using nitrogen pumped in a line in the umbilical. The valve is normally shut and then opened bleed off the pressure. A discharge (flaring gas) from the gas export tubing may be prevented with a first flushing device, and a discharge (crude oil) from the production tubing with a second flushing device.

In some embodiments, the early production system may include methanol bottles pre-charged to flood into flow base, minimizing potential for hydrocarbon discharge and reducing the risk of hydrate formation. Methanol bottles may be at atmospheric pressure as long as they have a preferred path into the flow base.

FIG. 1 illustrates an outer riser 316, the production riser 16, a retainer valve 312, an emergency disconnect 310, the flex joint 30, the lower marine riser package 14, two annular blowout preventers 314, the subsea test tree 28, a detachable connector 306, a pressure specification break between a zone 302 including equipment rated at 15,000 psi and a zone 304 including equipment rated at 20,000 psi, a tubing hanger running tool 390, the flow base 12 including the IPCS, which may optionally be used to implement the functionality of the HIPPS, shut down valves 308, the suction pile 22, a jumper 300, the tree 18, and the wellhead 20.

Figure 2:
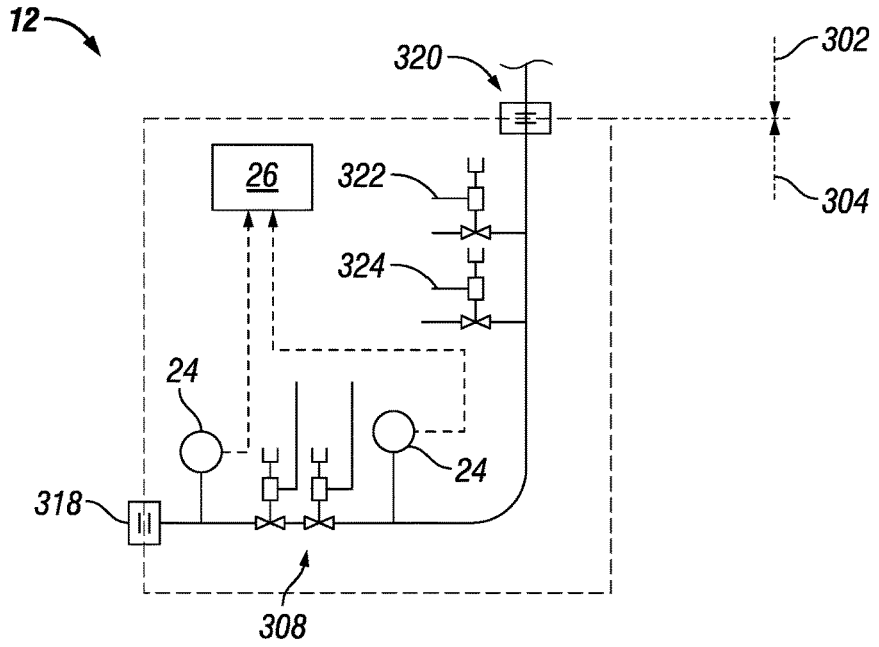
FIG. 2 is a schematic view of the flow base shown in FIG. 1.

FIG. 2 illustrates the flow base 12, including a connector 320 to LMRP, shut down logic 26, the pressure sensors 24, the shutdown valves 308, and valves 322 and 324, and jumper connection 318 to tree. Any of the shutdown valves 308, the valves 322 and the 324 may be used as a fail-safe valve. The flow base 12 is located upstream of the pressure specification break between the zone 302 and the zone 304.

Figure 3:
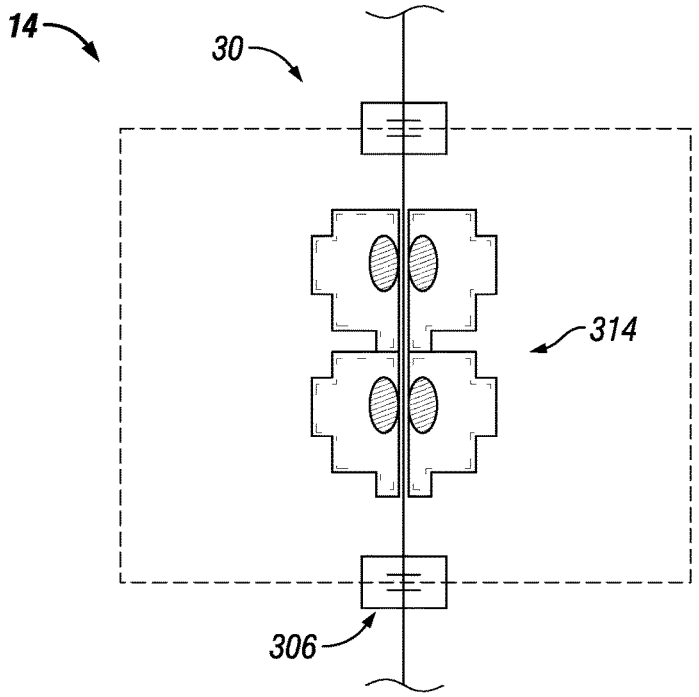
FIG. 3 is a schematic view of the LMRP shown in FIG. 1.

FIG. 3 illustrates the LMRP 14, including the flex joint 30, the two annular blowout preventers 314, and a connection 306 to the flow base. The LMRP 14 is located downstream of the pressure specification break between the zone 302 and the zone 304.

Referring to FIGS. 1, 2 and 3, an early production system 10 comprises a flow base 12 and an LMRP 14 with enhanced HIPPS functionality. The early production system 10 can be used to produce from a reservoir having a Shut-In Tubing Pressure ("SITP") that may be greater than 15,000 psi. As such, the early production system 10 usually requires a 20K subsea tree 18 (i.e., a subsea tree rated to at least 20,000 psi) that is capping the wellhead 20 located on the sea floor. However, the early production system 10 permits flow of reservoir hydrocarbon to a processing facility at the sea surface using conventional equipment to the greatest extent possible. As such, the early production system 10 can be used with a standard MODU drilling riser, including production riser 16.

In this example, the flow base 12 can be connected to a structural foundation 22 on the seafloor, which can include any of the standard methods of structural foundation (driven pile, suction pile, mud mat, other). The flow base 12 includes a HIPPS, which is provided by a combination of sensors 24 and a control pod including logic electronics 26 that can initiate shutdown in cases where a pressure surge occurs above normal operating limits. Such pressure surge may occur when there has been a loss of integrity of a choke provided in the 20K subsea tree or of the 20K subsea tree itself. The connection of the LMRP 14 to the processing facility located on the sea surface is made using a standard drilling riser (for example, of the type that will be typical to standard 6th generation MODUs 15K equipment) with an inner riser that is made up for standard 15,000 psi subsea test tree configuration. Design of systems that use HIPPS will typically require a "reinforced length" downstream of the HIPPS unit, which in this case can be provided by the subsea test tree 28 and landing string.

The HIPPS provides a full specification break for equipment above it. Because the HIPPS unit provides the break, the equipment downstream can be standard 15K equipment that is uprated to a higher rating. Thus, in this example, the equipment can be rated to lower pressures, once past the "reinforced length", including the surface flow head and jumper back to the drilling rig (in FIG. 7). In this way, the early production system 10 enables a standard 6th generation MODU to perform well test operations on reservoir in HPHT environment.

A possible downside to the early production system 10 is that it involves a rigid landing string that goes through the flex joint 30—a configuration that is typical of completion operations, but is one that is known to require operations in calmer sea states with small operating windows of the offset between of the processing facility and the LMRP 14. The operating window can be enlarged by the introduction of a joint of titanium with centralizers through the flex joint 30.

Figure 4:
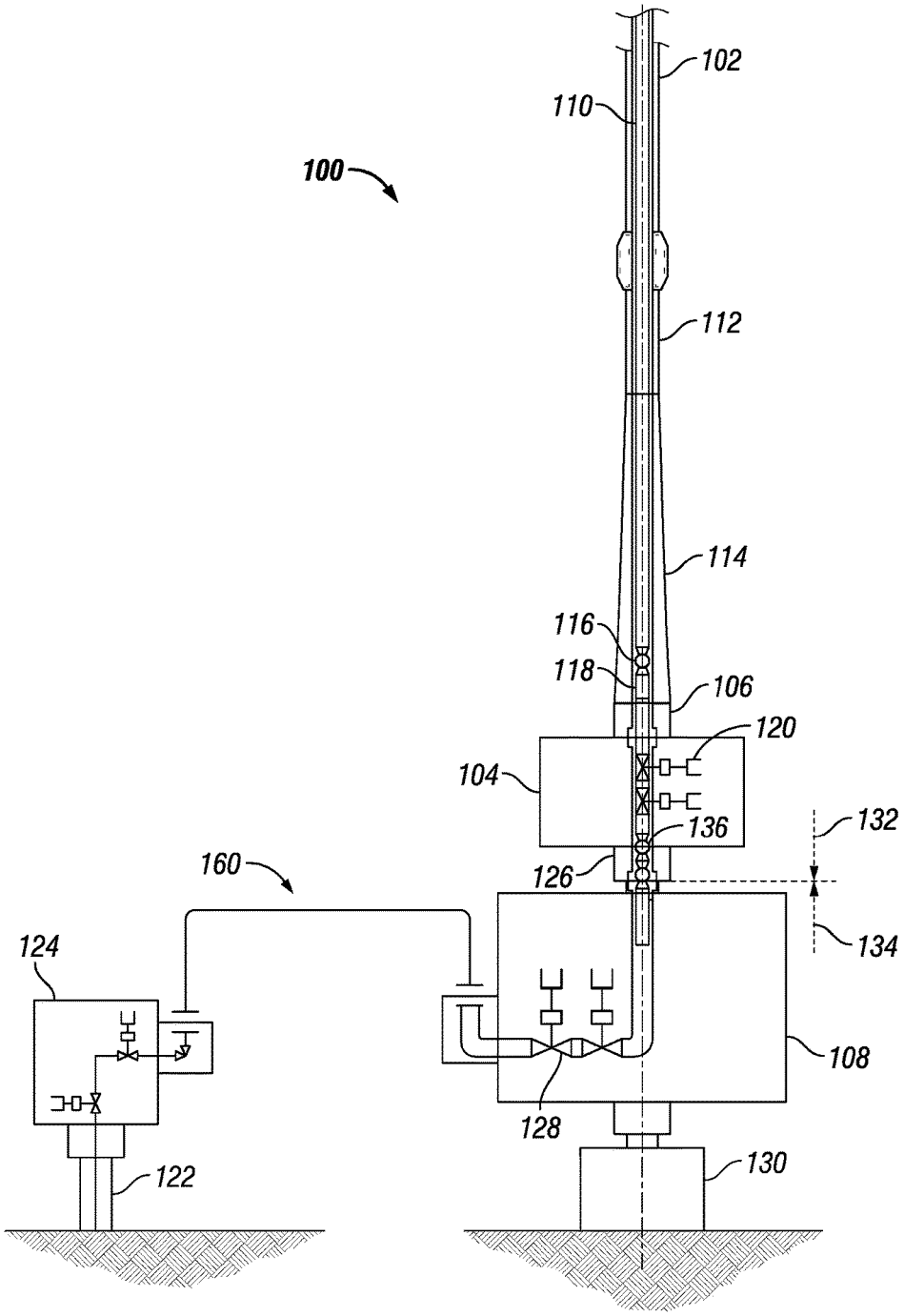
FIG. 4 is schematic view of an early production system in accordance with an embodiment of the disclosure.

FIG. 4 illustrates an outer riser 102, a production riser 110, a crossover 112, a tapered stress joint 114, a retainer valve 116, an emergency disconnect 118, an LRP 104, a connector 106, two full bore isolation valves 120, a subsea test tree 136, a connector 126, a jumper 160, a tree 124, a wellhead 122, a flow base 108 including the IPCS, which may optionally be used to implement the functionality of the HIPPS, shut down valves 128, and a suction pile 130. A pressure specification break separates a zone 132, which includes equipment rated at 15,000 psi, and a zone 134, which includes equipment rated at 20,000 psi.

Figure 5:
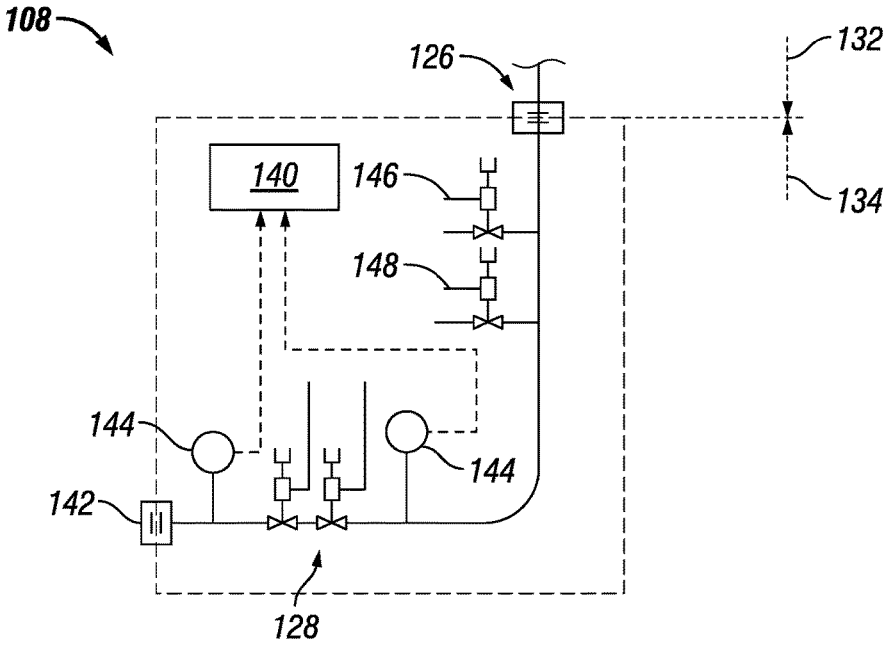
FIG. 5 is a schematic view of the flow base shown in FIG. 4.

FIG. 5 illustrates the flow base 108, including a connector 126 to LRP, shut down logic 140, the pressure sensors 144, the shutdown valves 128, and valves 146 and 148, and jumper connection 142 to tree. Any of the shutdown valves 128, the valves 146 and the 148 may be used as a fail-safe valve. The flow base 108 is located upstream of the pressure specification break between the zone 132 and the zone 134.

Figure 6:
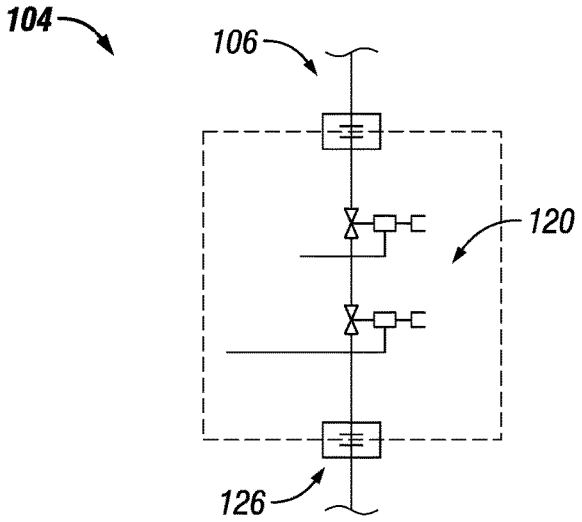
FIG. 6 is a schematic view of the LRP shown in FIG. 4.

FIG. 6 illustrates the LRP 104, including a connector 106 to riser, the full bore isolation valves 120, and the connector 106 to the flow base. The LRP 104 is located downstream of the pressure specification break between the zone 132 and the zone 134.

Referring now to FIGS. 4, 5 and 6, another early production system 100 may differ from the early production system 10 it that it comprises a high pressure outer riser 102. The high pressure outer riser 102 is connected to the LRP 104 via a simplified connector 106, such as an EDP provided on the top of the LRP 104 and the flow base 108. Again, the flow base 108 includes a HIPPS.

One advantage of using the connector 106 may be that the outer riser 102 can be rated to significantly higher pressure if desired, up to the extreme SITP that is expected in the well. The production riser 110 may not be rated to this high pressure, but may be rated to pressures typically in the range between 10,000 to 15,000 psi. Another advantage of using the connector 106 may be that the connector may include a stress joint at the interface to the LRP 104. A stress joint may enlarge the operating window of the offset between of the processing facility and the LRP 104, and may permit operation in rougher sea states. In this way, the early production system 100 enables either a DP drill ship, MODU or another similar vessel to perform well test operations, provided that sufficient vertical alignment can be assured.

Figure 7A:
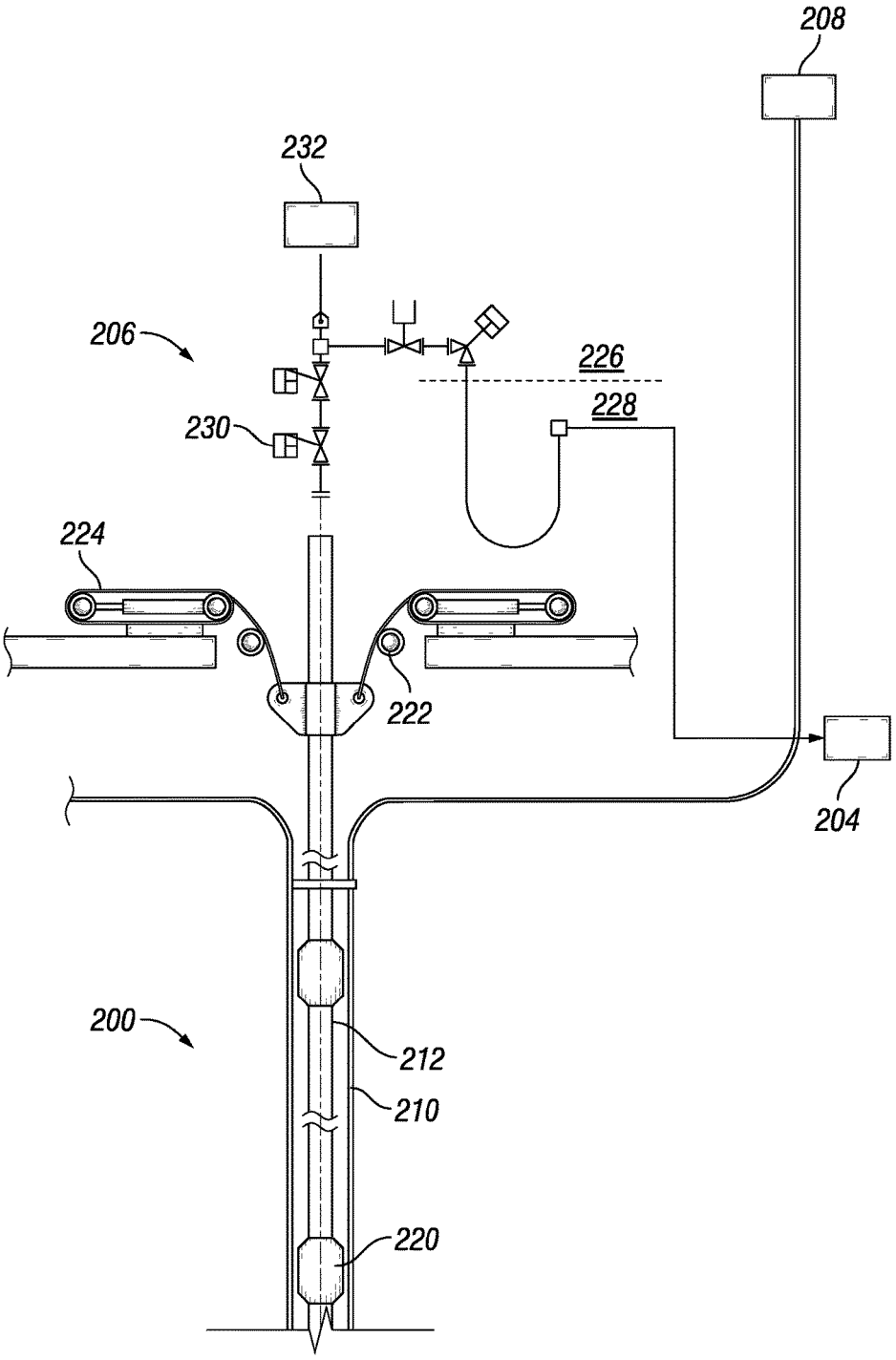
FIG. 7A is schematic view of an upper portion of an early production system in accordance with an embodiment of the disclosure.

FIG. 7A illustrates a surface production skid located below a rig 232, a flow head 206 including a Boarding Shut-Down Valve ("BSDV") 230, a pressure specification break that separates a zone 226 including equipment rated at 15,000 psi and a zone 228 including equipment rated at ANSI standard 900, a flowline to a process skid 204 (also shown in FIG. 9), a riser tensioner 224, a turndown sheave 222, a gas export tubing 210 connected to a boost compressor 208 (also shown in FIG. 9), riser joints 212 connected via Threaded and Coupled ("T&C") connections 220.

Figure 7B:
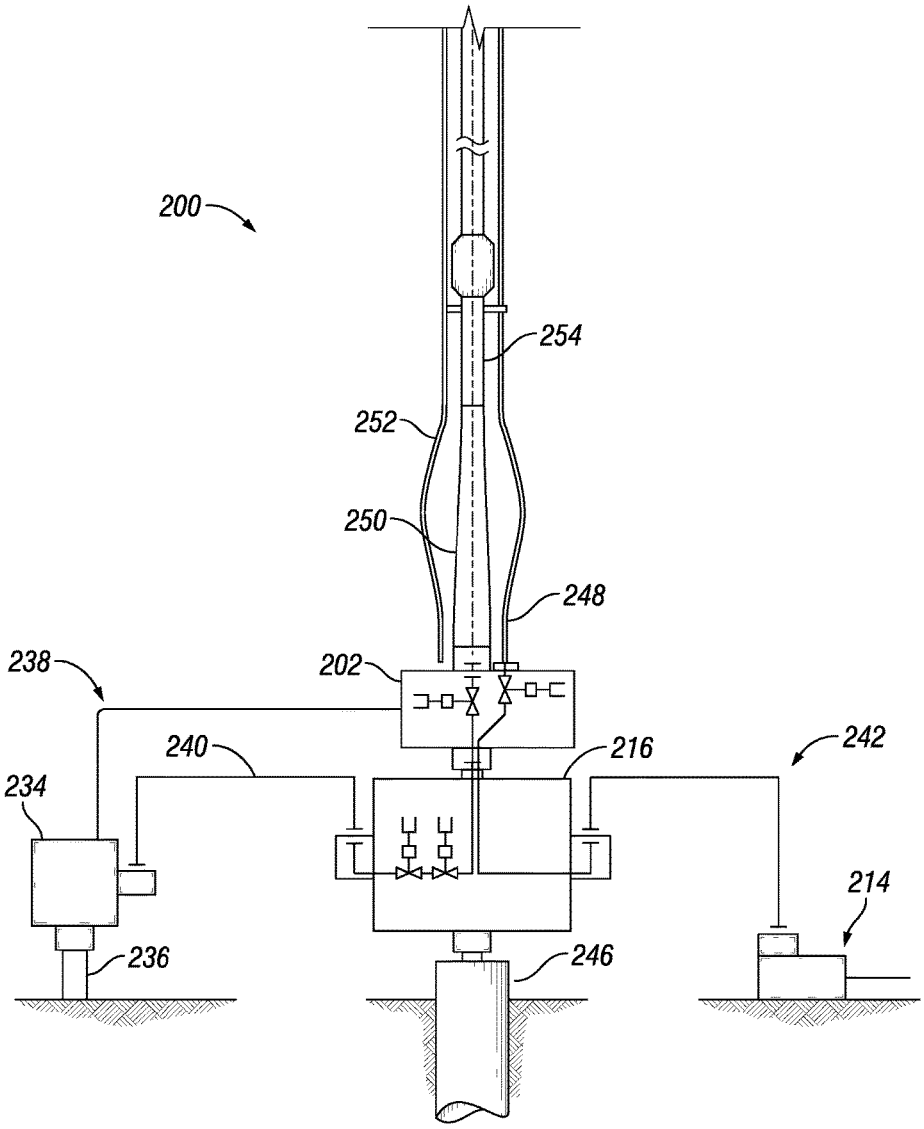
FIG. 7B is schematic view of a lower portion of the early production system shown in FIG. 7A.

FIG. 7B illustrates a crossover 254, an umbilical 252 for tree controls, a tapered stress joint 250, a flexible conduit 248 coupled to the gas export tubing 210, an emergency disconnect 202, a flying lead 238, a jumper 240, a tree 234, a wellhead 236, an export jumper 242, a PLET 214, a suction pile 246, and a flow base 216.

Figure 8:
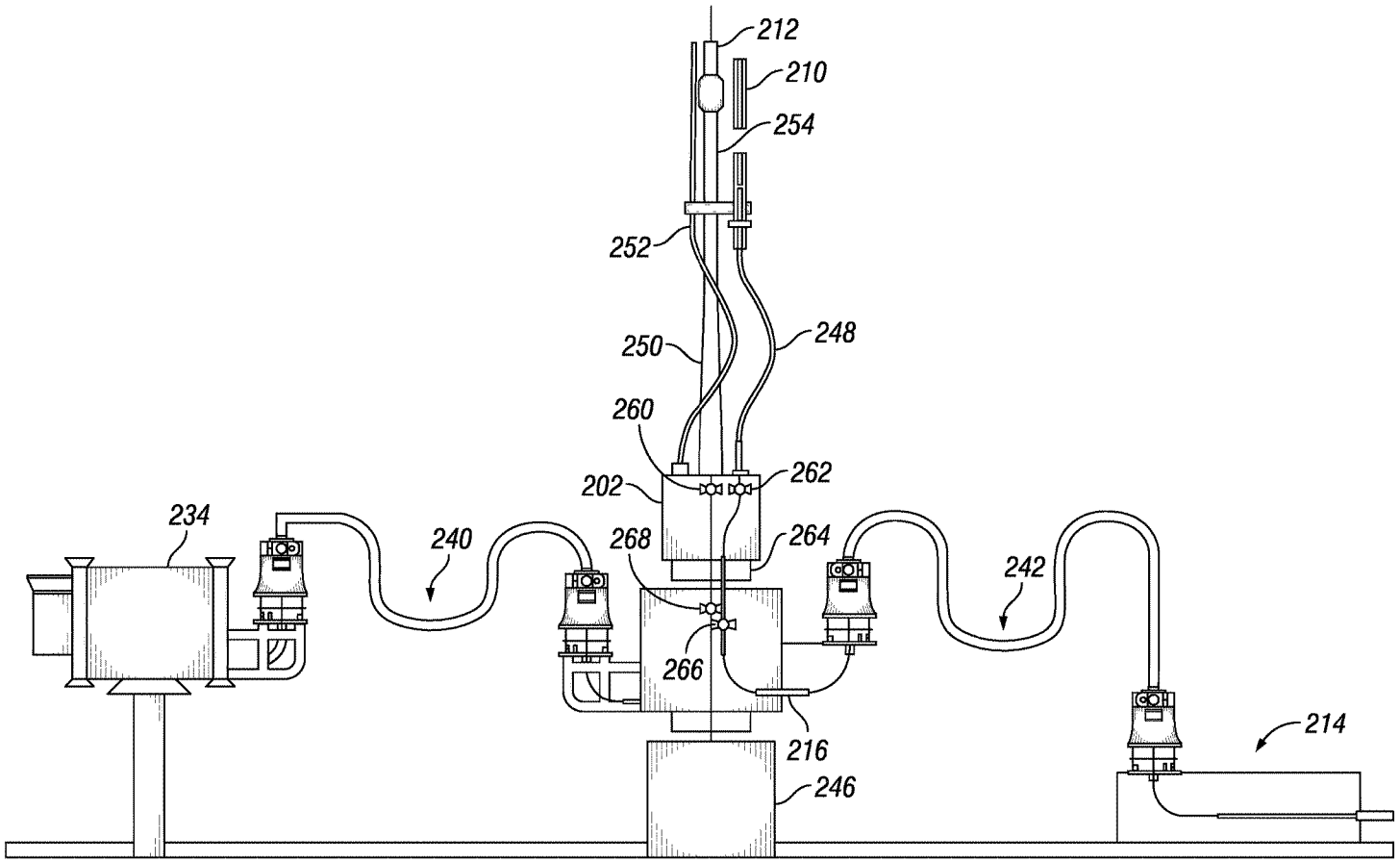
FIG. 8 is schematic view of a portion of the early production system shown in FIG. 7.

FIG. 8 shares several elements with FIG. 7B. In addition to FIG. 7B, FIG. 8 illustrates a Production Isolation Valve ("PIV") 260, a Gas export Isolation Valve ("GIV") 262, a dual port connector 264, and shutdown valves 268 and 266 which are controlled by an IPCS. The IPCS includes shutdown logic built in logic electronics that can also mitigate or prevent rapid discharge if a drive-off event has occurred. As mentioned before, the IPCS, by acting as a HIPPS, may also allow a reduction of the pressure specification, typically from 20,000 psi in the wellhead to 15,000 psi in the production riser.

Figure 9:
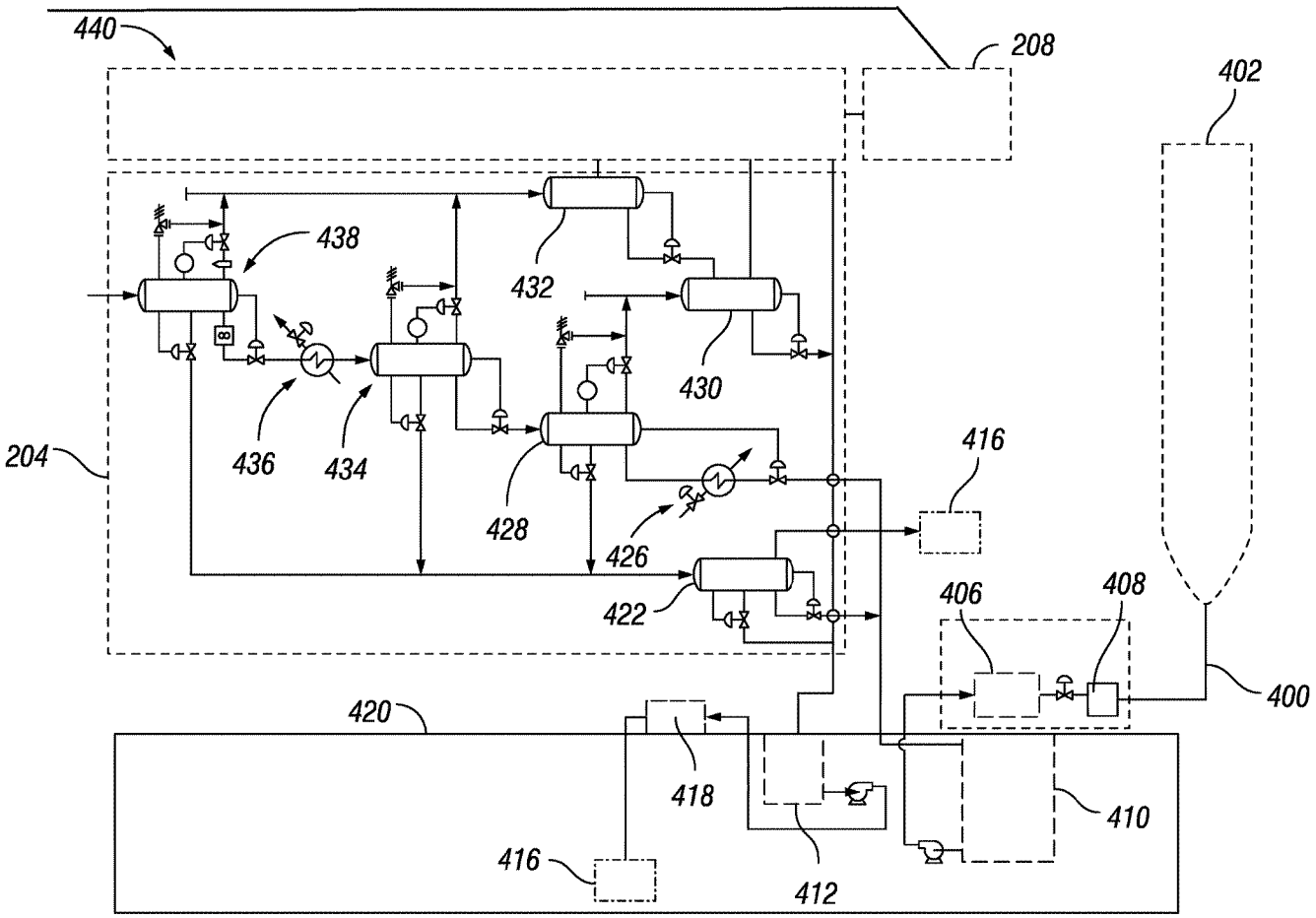
FIG. 9 is schematic view of a sea surface processing facility in accordance with an embodiment of the disclosure.

FIG. 9 illustrates a processing facility located on the sea surface. The processing facility includes a gas export skid 440 including one or more modules similar to the modules of the process skid 204, and a boost compressor 208. The gas export skid 440 receives gas from process skid 204. The modules of the process skid 204 may include a high pressure separator 438, a production heater 436, a low pressure separator 434, a high pressure scrubber 432, a low pressure scrubber 430, a crude oil degasser 428, a shale oil cooler 426, and a produced water skimmer/degasser 422. A vent 416 may be provided. Produced oil may be stored on deck 420 in an oil tank 410, and pumped into a Lease Automatic Custody Transfer ("LACT") unit 406, a hose reel 408, break away couplings 400 into a ship 402. Produced water may be stored on deck 420 in a slop tank 412, and pumped in a water skid 418 and overboard at 416.

It is common to want to conduct well test operations even when flaring is not allowed. In these cases, gas export of some sort may therefore be required. Referring now to FIGS. 7A 7B, 8 and 9, another early production system 200 is illustrated not having an LRP or LMRP connected between the emergency disconnect 202 and the flow base 216, and having optional means for providing gas export.

The gas is extracted in a process skid 204 that is connected to the flow head 206. The gas is compressed in boost compressor 208. The gas is then conducted from the surface, where it will flow compressed through drape hoses to a surface flow unit that sits below or surrounding the flow head 206. This flow unit transitions to small diameter lines of a gas export tubing 210 that are run in the annulus between an outer riser (not shown in FIG. 7 nor 8) and the production riser 212 and in the emergency disconnect 202. At the base of the emergency disconnect 202, there is an annulus formed around the tubing hanger running tool that provides a conduit between the gas export tubing 210 and the PLET 214 connected to a flow base 216. The emergency disconnect 202 and the flow base 216 provide a second set of disconnect valves for the gas export tubing 210.

This system will allow the gas to flow from the surface flow unit, down through the gas export tubing, into the annulus, down through the emergency disconnect gas export means and into the gas export pipeline at the seafloor. A small diameter pipeline can be run to an export point.

Figure 10:
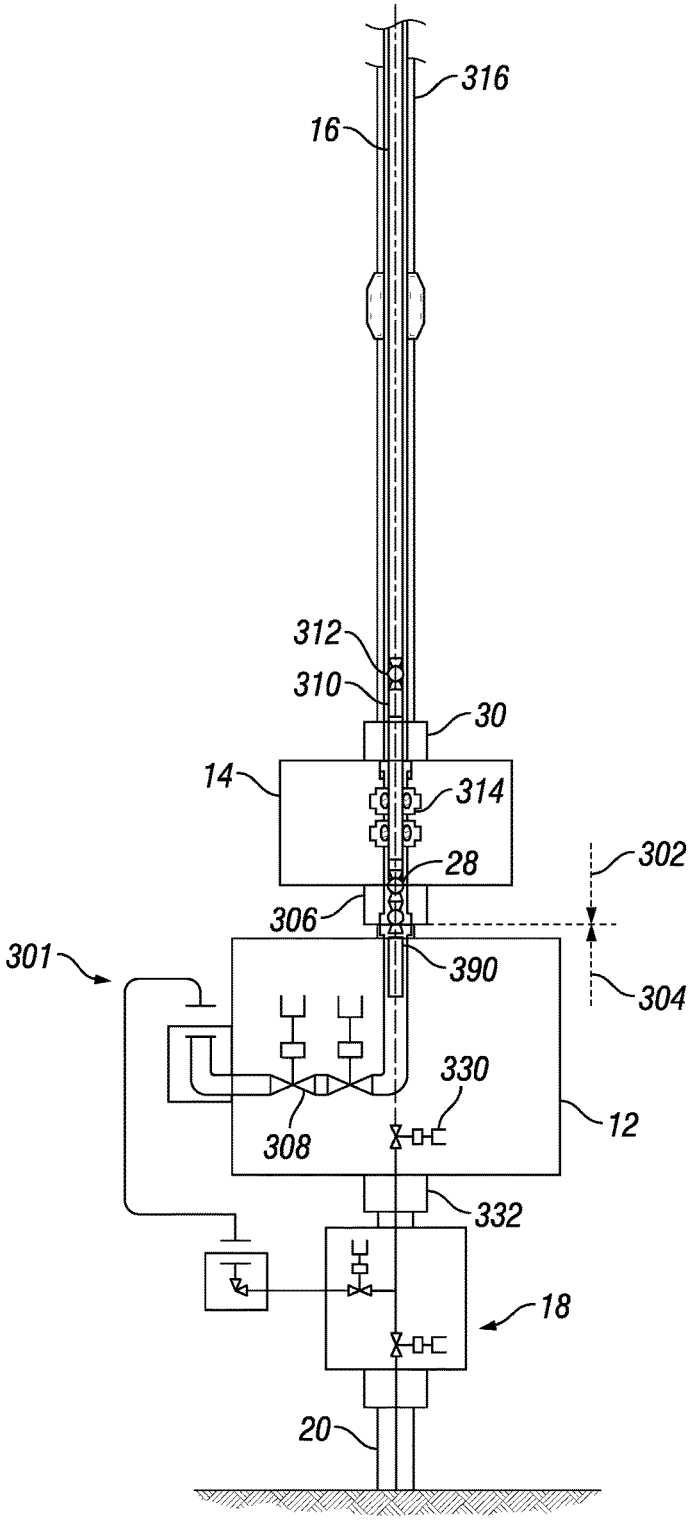
FIG. 10 is schematic view of an early production system in accordance with an embodiment of the disclosure.

The early production system illustrated in FIG. 10 shares several elements with the early production system illustrated FIGS. 1, 2 and 3. However, in this example, the flow base 12 is not located on a suction pile 22, but on the tree 18. A jumper 301 connects the tree 18 to the flow base 12. In addition, a connector 332 and an isolation valve 330 may be used access the wellbore for intervention operations.

Figure 11A:
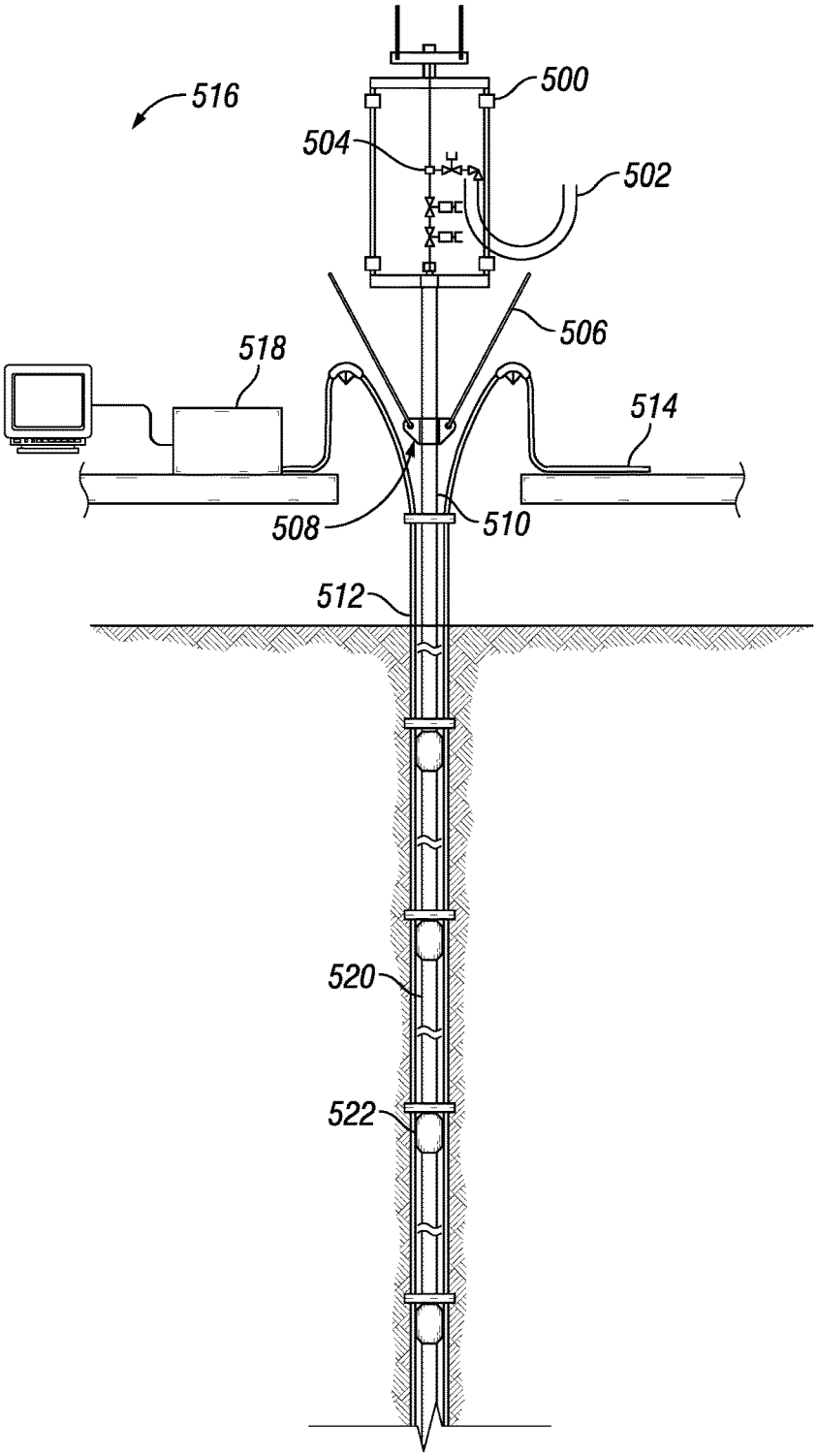
FIG. 11A is schematic view of an upper portion of an early production system in accordance with an embodiment of the disclosure.

FIG. 11A illustrates a tension frame and guide system 500 connected below a drilling rig (not shown), a flow head 504, a flexible flowline 502, tensioner 506, an Hydraulic Power Unit/Energy Processing Unit/Power Distribution Unit 518, a topside computer 516, a tension ring 508, a tension joint 510, an umbilical 512, a gas export tubing 514, riser joints 520, T&C connections 522.

Figure 11B:
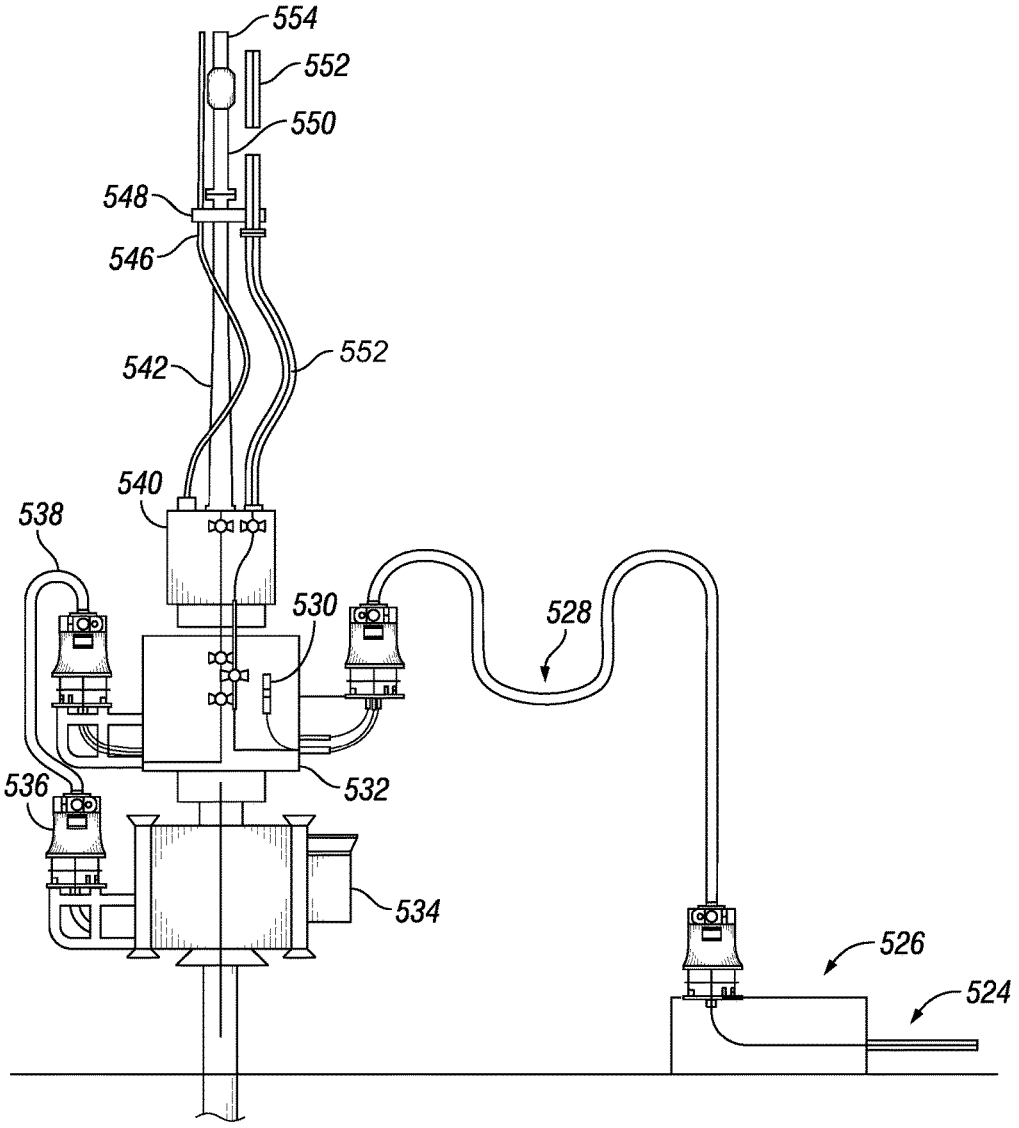
FIG. 11B is schematic view of a lower portion of the early production system shown in FIG. 11A.

FIG. 11B illustrates a production riser 554, a gas export riser 552, a crossover 550, a clamp 548, the lower end 546 of the umbilical 512, a tapered stress joint 542, an EDP 540, a jumper 538, a connector 536, a tree 534, a flow base 532 including an IPCS, a pig receiver 530, a gas jumper 528, a PLET 526, a gas export flowline 524.

The early production system illustrated in FIGS. 11A and 11B shares several elements with the early production system illustrated FIGS. 7A, 7B and 8. However, in this example, the flow base 532 is not located on a suction pile, but on the tree 534. A jumper 538 connects the tree 534 to the flow base 532.

Figure 12:
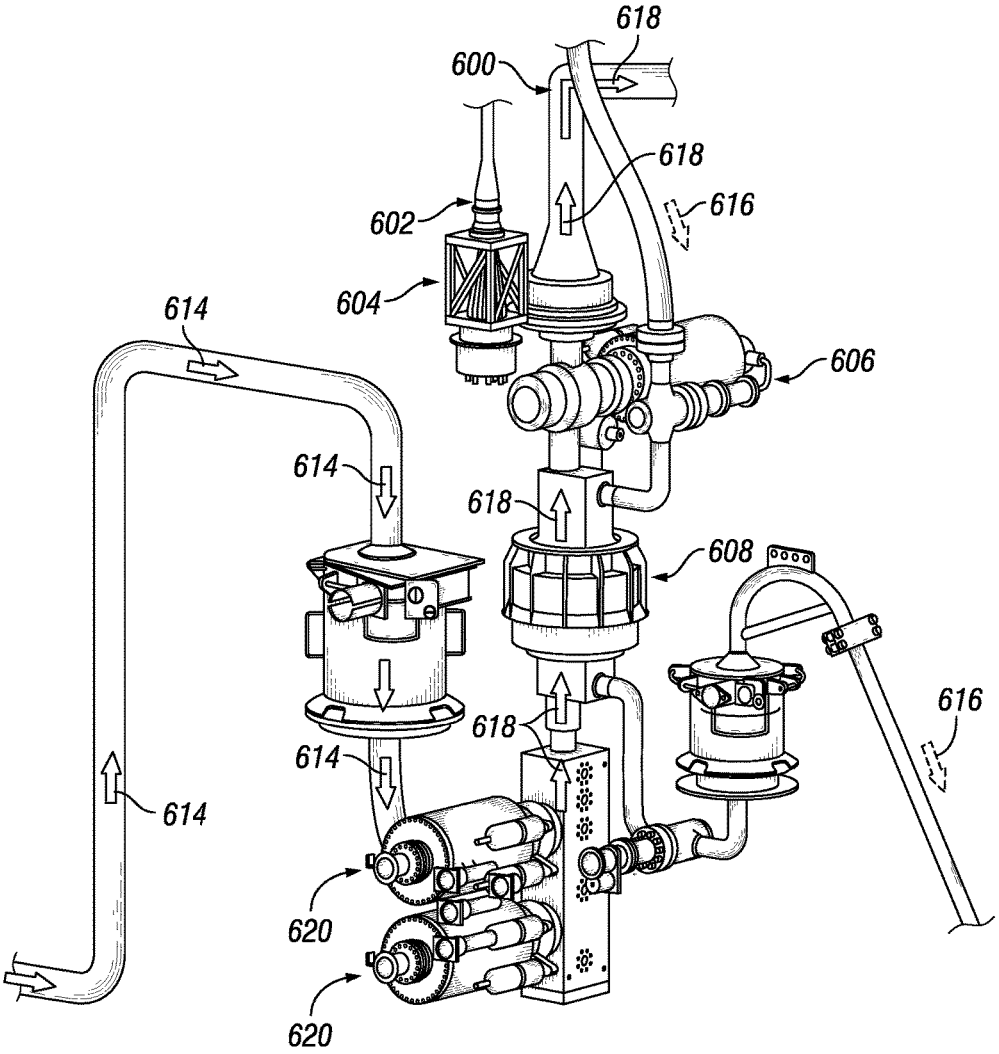
FIG. 12 is schematic view of an early production system in accordance with an embodiment of the disclosure.

FIG. 12 illustrates the flow 614 of crude oil through equipment rated for 20,000 psi, the flow 618 of crude oil though equipment rated for 15,000 psi, the two flow zones being separated a valve block 620 of a HIPPS. Also illustrated in FIG. 12 is the flow 616 of gas (for example at a pressure of 3,000 psi). FIG. 12 illustrate a riser 600 rated at 15,000 psi, an umbilical 602, a subsea Umbilical Termination Assembly ("UTA") 604, a dual bore collet connector 608, and a fail-safe close gas valve 606.

Figure 13:
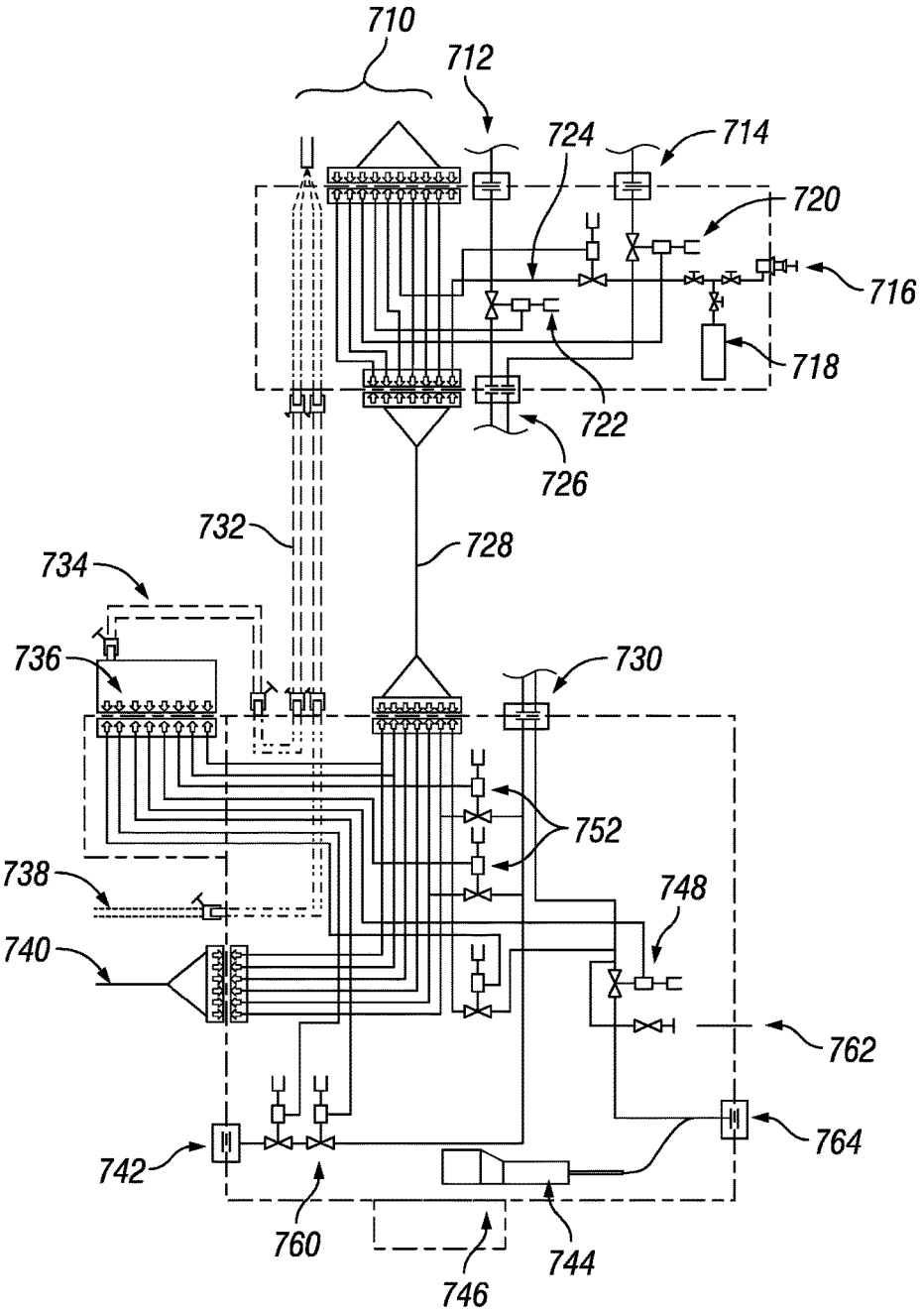
FIG. 13 is schematic view of an early production system in accordance with an embodiment of the disclosure.

FIG. 13 illustrates the emergency disconnect (on top) and the flow base (at the bottom) shown in FIG. 11B. FIG. 13 shows an umbilical 710, a connection 712 to riser, a flexible export termination 714, a methanol line 724, a nitrogen bottle 718, a nitrogen flush 716, a production relief valve 722, a gas relief valve 720, electric flying leads 732 and 734, hydraulic flying leads 728, electric flying leads 738 to tree, hydraulic flying leads to tree 740, a jumper connection to tree 742, a blind connector to tree 746, a pig receiver 744, PIV's 760, gas isolation valve 748, jumper connection for gas export 764, Nitrogen vent to sea 762, valves 752, dual port connector 730 to EDP, dual port connector 726 to flow base.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. An early production system, comprising:

an Emergency Disconnect Package ("EDP") including a first conduit having a fail-safe close production valve, and an EDP connector having a first port fluidly coupled to the first conduit;

a production riser coupled between the first conduit of the EDP and a Dynamically Positioned Vessel;

a flow base including a second conduit having production shut-down valves, an Independent Production Control System ("IPCS") for controlling the production shut-down valves, a first sensor of wellbore pressure or temperature, and a flow base connector having a second port fluidly coupled to the second conduit, wherein the flow base connector is detachably connectable to the EDP connector, and wherein the first port and the second port are in fluid communication upon connection of the flow base connector with the EDP connector;

a jumper coupled between the second conduit and a wellhead tree capping a wellbore; and a control pod having pre-charged accumulators and logic electronics that is communicatively coupled to the first sensor and to the IPCS, wherein the control pod is configured to operate the production shut-down valves even after disconnection of the EDP from the flow base, and wherein the logic electronics are programmed to shut down flow between the flow base and the EDP based on a signal generated by the first sensor.

2. The early production system of claim 1, wherein the logic electronics are further programmed to control pressure surges in the production riser.

3. The early production system of claim 1, further comprising a second sensor of positioning of the Dynamically Positioned Vessel over the wellbore.

4. The early production system of claim 3, wherein the second sensor is an inclinometer positioned in the flow base.

5. The early production system of claim 1, wherein the control pod is coupled to valves located in the wellhead tree via flying leads, and wherein the logic electronics are programmed to control the valves even after disconnection of the EDP from the flow base.

6. The early production system of claim 5, further comprising an umbilical running along the production riser, the umbilical comprising flying leads connected to the valves located in the wellhead tree to control the valves before disconnection of the EDP from the flow base.

7. The early production system of claim 1 wherein the flow base is connected to a structural foundation.

8. The early production system of claim 1 wherein the flow base is connected to the wellhead tree.

9. The early production system of claim 1 wherein the Dynamically Positioned Vessel is a Mobile Offshore Drilling Unit ("MODU"), a drill ship, a Production Vessel, or an Intervention Vessel.

10. An early production system, comprising:

an Emergency Disconnect Package ("EDP") including a first conduit having a fail-safe close production valve, and an EDP connector having a first port fluidly coupled to the first conduit;

a production riser coupled between the first conduit of the EDP and a Dynamically Positioned Vessel;

a flow base including a second conduit having production shut-down valves, an Independent Production Control System ("IPCS") for controlling the production shut-down valves, a first sensor of wellbore pressure or temperature, and a flow base connector having a second port fluidly coupled to the second conduit, wherein the flow base connector is detachably connectable to the EDP connector, and wherein the first port and the second port are in fluid communication upon connection of the flow base connector with the EDP connector;

a jumper coupled between the second conduit and a wellhead tree capping a wellbore; and a control pod having battery packs, a pumping system, and logic electronics that is communicatively coupled to the first sensor and to the IPCS wherein the control pod is configured to operate the production shut-down valves even after disconnection of the EDP from the flow base, and wherein the logic electronics are programmed to shut down flow between the flow base and the EDP based on a signal generated by the first sensor.

11. The early production system of claim 10, wherein the logic electronics are further programmed to control pressure surges in the production riser.

12. The early production system of claim 10, further comprising a second sensor of positioning of the Dynamically Positioned Vessel over the wellbore.

13. The early production system of claim 12, wherein the second sensor is an inclinometer positioned in the flow base.

14. The early production system of claim 10, wherein the control pod is coupled to valves located in the wellhead tree via flying leads, and wherein the logic electronics are programmed to control the valves even after disconnection of the EDP from the flow base.

15. The early production system of claim 14, further comprising an umbilical running along the production riser, the umbilical comprising flying leads connected to the valves located in the wellhead tree to control the valves before disconnection of the EDP from the flow base.

16. The early production system of claim 10 wherein the flow base is connected to a structural foundation.

17. The early production system of claim 10 wherein the flow base is connected to the wellhead tree.

18. The early production system of claim 10 wherein the Dynamically Positioned Vessel is a Mobile Offshore Drilling Unit ("MODU"), a drill ship, a Production Vessel, or an Intervention Vessel.

19. A method of operating an early production system, comprising:

providing an Emergency Disconnect Package ("EDP") including a first conduit having a fail-safe close production valve, and an EDP connector having a first port fluidly coupled to the first conduit;

coupling a production riser between the first conduit of the EDP and a Dynamically Positioned Vessel;

providing a flow base including a second conduit having production shut-down valves, an Independent Production Control System ("IPCS") for controlling the production shut-down valves, a first sensor of wellbore pressure or temperature, and a flow base connector having a second port fluidly coupled to the second conduit, connecting the flow base connector to the EDP connector, wherein the first port and the second port are in fluid communication upon connection of the flow base connector with the EDP connector;

coupling a jumper between the second conduit and a wellhead tree capping a wellbore;

providing a control pod having pre-charged accumulators and logic electronics that is communicatively coupled to the first sensor and to the-IPCS;

causing the production shut-down valves to limit pressure surges in the production riser; and causing the production shut-down valves to shut down a flow between the flow base and the EDP based on a signal generated by the first sensor.

20. The method of operating an early production system of claim 19, further comprising:

providing a second sensor of a dynamic positioning that generates a signal indicative of a positioning of the Dynamically Positioned Vessel over the wellbore;

causing the production shut-down valves to shut down a flow between the flow base and the EDP in response to the signal of the second sensor exceeding a critical value;

causing the EDP to disconnect from the flow base in response to the signal of the second sensor exceeding the critical value.

21. The method of operating an early production system of claim 19, further comprising:

disconnecting the flow base connector from the EDP connector; and causing the production shut-down valves to maintain shutdown of the flow between the flow base and the EDP after disconnection of the EDP from the flow base.

22. The method of operating an early production system of claim 19, further comprising:

providing valves in the wellhead tree;

coupling the control pod to the valves via flying leads; and causing the IPCS to close the valves after disconnection of the EDP from the flow base.

23. The method of operating an early production system of claim 22, further comprising:

providing an umbilical running along the production riser, the umbilical comprising flying leads connected to the valves located in the wellhead tree; and using the umbilical to control the valves before disconnection of the EDP from the flow base.

24. The method of operating an early production system of claim 19, further comprising flushing at least a portion of the first conduit or the second conduit prior to disconnecting the flow base connector from the EDP connector.

25. The method of operating an early production system of claim 19, further comprising causing the IPCS to shut down flow between the flow base and the EDP after detection of a pressure drop.

26. The method of operating an early production system of claim 19, further comprising initiating disconnection of the EDP from the flow base after causing the production shut-down valves to shut down a flow between the flow base and the EDP based on a signal generated by the first sensor.

27. The method of operating an early production system of claim 26, wherein initiating disconnection of the EDP from the flow base comprises releasing a lock between the flow base connector and the EDP connector.

28. A method of operating an early production system, comprising:

providing an Emergency Disconnect Package ("EDP") including a first conduit having a fail-safe close production valve, and an EDP connector having a first port fluidly coupled to the first conduit;

coupling a production riser between the first conduit of the EDP and a Dynamically Positioned Vessel;

providing a flow base including a second conduit having production shut-down valves, an Independent Production Control System ("IPCS") for controlling the production shut-down valves, a first sensor of wellbore pressure or temperature, and a flow base connector having a second port fluidly coupled to the second conduit, connecting the flow base connector to the EDP connector, wherein the first port and the second port are in fluid communication upon connection of the flow base connector with the EDP connector;

coupling a jumper between the second conduit and a wellhead tree capping a wellbore;

providing a control pod having battery packs, a pumping system, and logic electronics that is communicatively coupled to the first sensor and to the IPCS;

causing the production shut-down valves to limit pressure surges in the production riser; and causing the production shut-down valves to shut down a flow between the flow base and the EDP based on a signal generated by the first sensor.

29. The method of operating an early production system of claim 28, further comprising:

providing a second sensor of a dynamic positioning that generates a signal indicative of a positioning of the Dynamically Positioned Vessel over the wellbore;

causing the production shut-down valves to shut down a flow between the flow base and the EDP in response to the signal of the second sensor exceeding a critical value;

causing the EDP to disconnect from the flow base in response to the signal of the second sensor exceeding the critical value.

30. The method of operating an early production system of claim 28, further comprising:

disconnecting the flow base connector from the EDP connector; and causing the production shut-down valves to maintain shutdown of the flow between the flow base and the EDP after disconnection of the EDP from the flow base.

31. The method of operating an early production system of claim 28, further comprising:

providing valves in the wellhead tree;

coupling the control pod to the valves via flying leads; and causing the IPCS to close the valves after disconnection of the EDP from the flow base.

32. The method of operating an early production system of claim 31, further comprising:

providing an umbilical running along the production riser, the umbilical comprising flying leads connected to the valves located in the wellhead tree; and using the umbilical to control the valves before disconnection of the EDP from the flow base.

33. The method of operating an early production system of claim 28, further comprising flushing at least a portion of the first conduit or the second conduit prior to disconnecting the flow base connector from the EDP connector.

34. The method of operating an early production system of claim 28, further comprising causing the IPCS to shut down flow between the flow base and the EDP after detection of a pressure drop.

35. The method of operating an early production system of claim 28, further comprising initiating disconnection of the EDP from the flow base after causing the production shut-down valves to shut down a flow between the flow base and the EDP based on a signal generated by the first sensor.

36. The method of operating an early production system of claim 35, wherein initiating disconnection of the EDP from the flow base comprises releasing a lock between the flow base connector and the EDP connector.

* * * * *